United States Patent [19]

Gunther, Jr.

[11] 4,106,432

[45] Aug. 15, 1978

[54] APPARATUS FOR APPLYING CHEMICALS TO ENVELOPES

[75] Inventor: William H. Gunther, Jr., Guilford, Conn.

[73] Assignee: Thor Dahl, Inc., New York, N.Y.

[21] Appl. No.: 677,890

[22] Filed: Apr. 19, 1976

[51] Int. Cl.[2] ..... B05C 1/02

[52] U.S. Cl. ..... 118/211; 118/221; 118/224; 118/228; 118/236; 118/239; 118/252

[58] Field of Search ..... 427/284, 285; 118/221, 118/223, 224, 227, DIG. 9, 6, 239, 236, 252, 211, 228

[56] References Cited

U.S. PATENT DOCUMENTS

| | | | |
|---|---|---|---|
| 1,597,099 | 8/1926 | Mitchell | 118/236 X |
| 2,101,427 | 12/1937 | Conradi et al. | 118/221 X |
| 2,167,063 | 7/1939 | Brand | 118/224 |
| 2,348,864 | 5/1944 | Staude | 118/221 X |
| 2,548,456 | 4/1951 | Wells | 118/3 |
| 3,395,673 | 8/1968 | Klein et al. | 118/6 X |
| 3,664,296 | 5/1972 | Stamp et al. | 118/252 X |

*Primary Examiner*—John P. McIntosh

*Attorney, Agent, or Firm*—Holland, Armstrong, Wilkie & Previto

[57] ABSTRACT

Apparatus for applying a coating to edges of envelopes. The envelopes are fed from a stack feeding device to a first conveyor which conveys them past a roller which applies the coating to one edge. A dead plate receives the envelopes from the first conveyor and feeds them to a second conveyor which is at right angles to the first conveyor. Applicator rollers are placed on opposite sides of the second conveyor to coat opposing edges of the envelopes.

1 Claim, 6 Drawing Figures

14
15
16
30
30
1
10
19
12
32
17
11
21
20
33
22
22
13
35
24
25
2
3
4
5
6
7
8

APPARATUS FOR APPLYING CHEMICALS TO ENVELOPES

DESCRIPTION

The present invention is directed to a method of applying chemicals to three edges of an envelope so that upon the application of heat the edges of the envelope will disintegrate to open the envelope. This procedure of chemically opening envelopes is described in U.S. Pat. Nos. 3,677,460; 3,871,573 and 3,816,213, the details of which are incorporated herein by reference.

In such procedure for opening envelopes chemically, three edges of the envelope are coated with a first chemical, called a sensitizing chemical and a second chemical, called a developing chemical. The chemicals may be applied one after the other, or, as is preferred in this application, both, sensitizing and developing chemicals may be applied together.

It has been proposed to spray the chemicals on the three sides and it has been proposed that other means of applying the chemical be used such as rollers and the like be used.

The present invention is directed to an improved mechanism for automatically coating the three edges of an envelope expeditiously.

Another objective of the present invention is the provision of an improved mechanism whereby envelopes are coated on three edges with minimum handling.

Another objective of the present invention is the provision of an improved mechanism whereby the amount of chemicals applied are adequately controlled by the mechanism and method of the present invention.

Another objective of the present invention is the provision of an improved mechanism whereby the envelopes are coated individually seriatim.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein.

Figures 1, 2, 3, 4, 5:
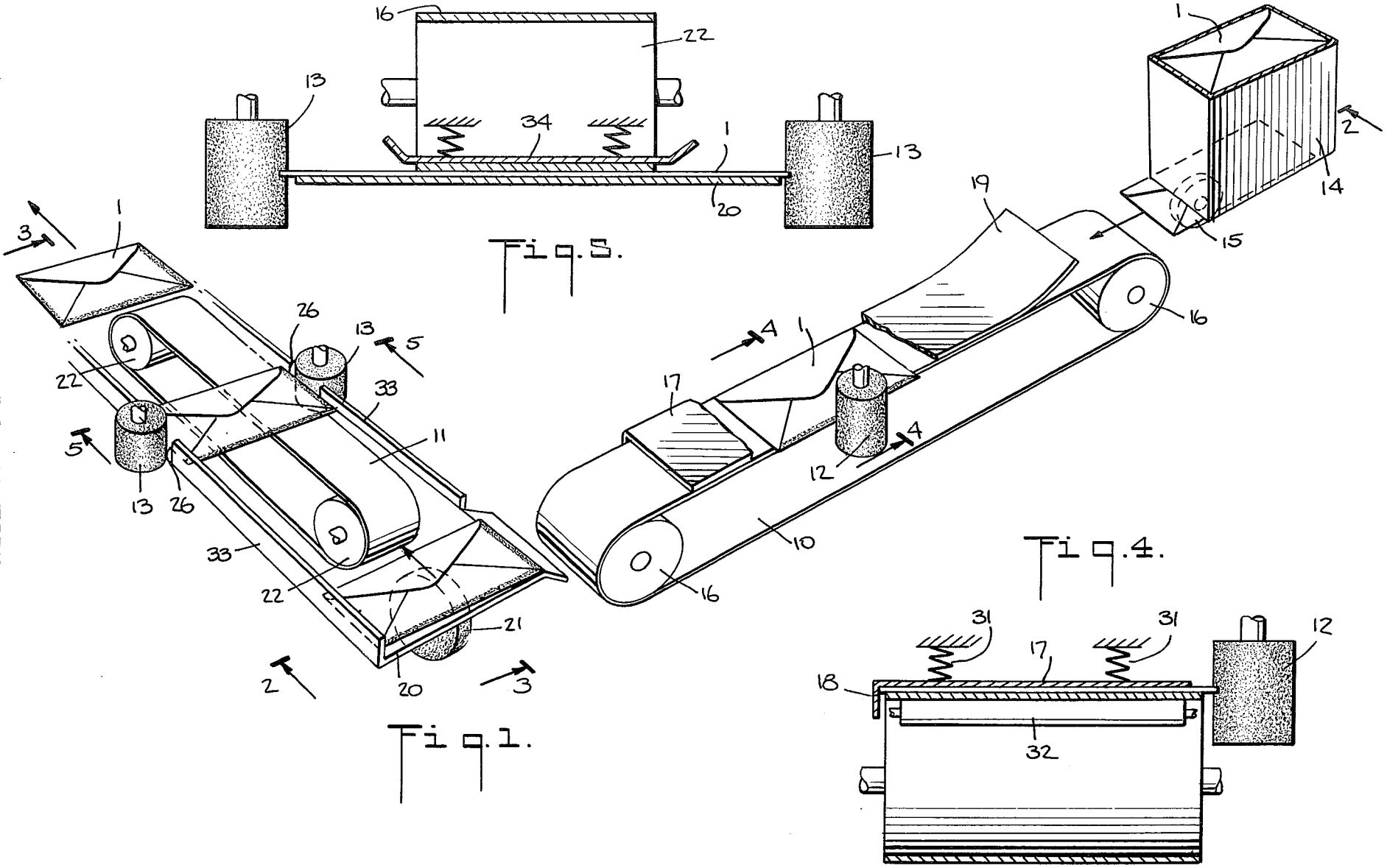
FIG. 1 is a diagramatic view of the mechanism made in accordance with the present invention.
FIG. 2 is a sectional view taken along line 2—2 of FIG. 1.
FIG. 3 is a sectional view taken along line 3—3 of FIG. 1.
FIG. 4 is a sectional view taken along line 4—4 of FIG. 1.
FIG. 5 is a sectional view taken along line 5—5 of FIG. 1.
Figures 2, 3, 6:
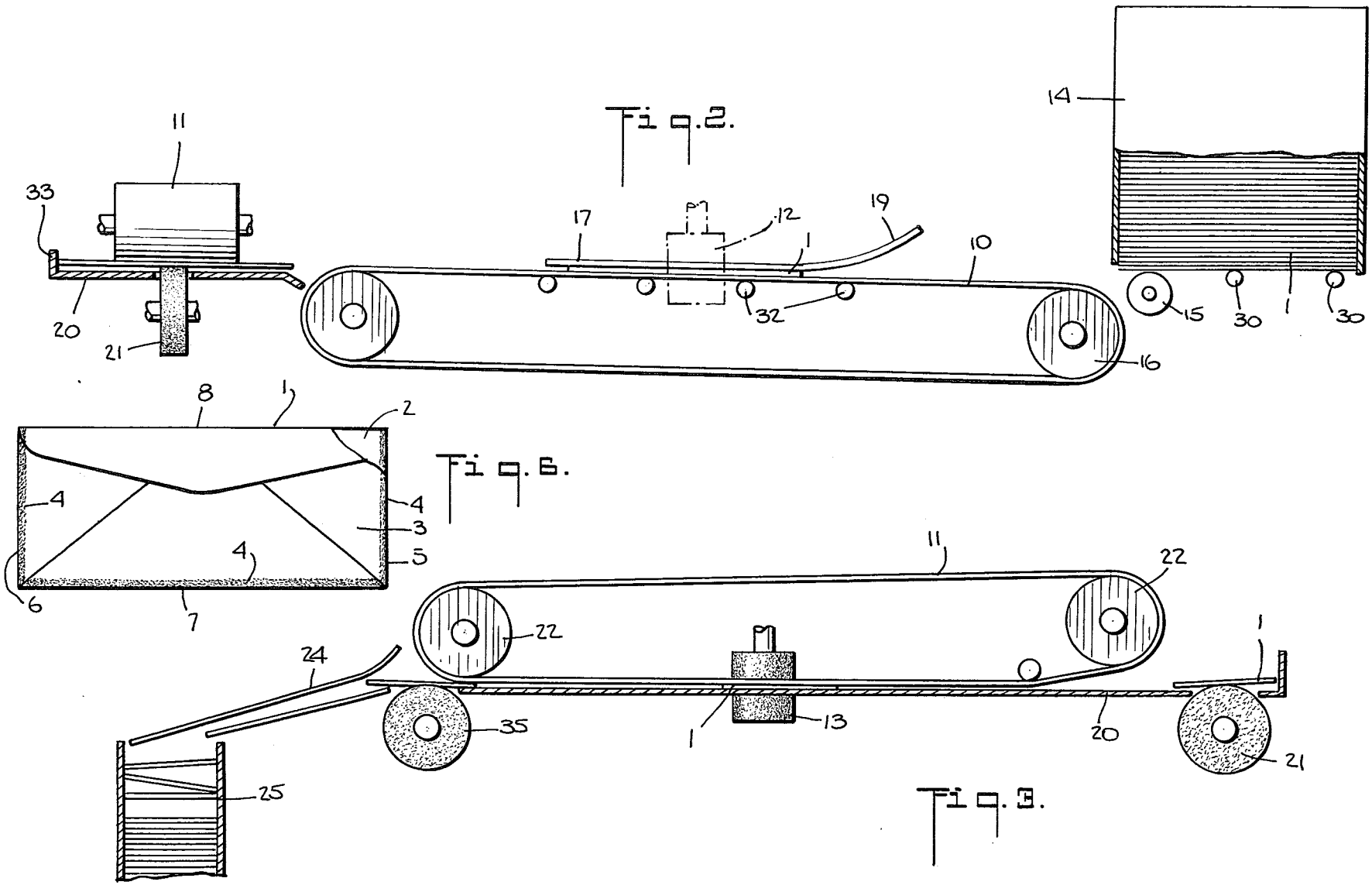
FIG. 6 is plan view of the envelope coated in accordance with the present invention.

Referring to FIG. 6, the envelope of the present invention comprises front and rear panels 2 and 3 and has the necessary chemicals applied along the two end edges 5 and 6 and the bottom edge 7. Preferably the top edge 8 is kept free of chemicals. This is fully described in said U.S. Pat. Nos. 3,677,460; 3,871,573 and 3,816,213.

In general, envelopes 1 are moved along a pair conveyors 10 and 11 which are at right angles to each other. The conveyor 10 moves the envelopes past an applicator roller 12 which applies the chemical to the bottom edge 7.

The envelope is then moved to the second conveyor 11 at right angles to the first conveyor. This moves the envelopes in a path at right angles to the original path and past a pair of applicator rollers 13 which will apply chemical to the end edges 5 and 6 of the envelope.

Preferably, the envelopes are stacked in an open bottomed hopper 14, over rollers 30 by a roller 15 and are fed from the open bottom thereof onto the conveyor 10. The conveyor 10 moves, by means of rollers 16, in a direction parallel to the long edge of the envelope so that the envelope is moved by conveyor 10, in a longitudinal path.

A hold down shoe 17 is provided to prevent the envelope from moving off the conveyor 10, spring elements 31 hold the shoe 17 down over support rollers 32. The shoe 17 has a rear upwardly extending portion 19 and has a downwardly extending lip 18, which forces the bottom edge of the envelope to extend beyond the conveyor 10 so that it can come into contact with applicator roller 12.

The applicator roller is preferably of porous steel and receives chemcials from the usual font (not shown) and applies it to the long bottom edge of the envelopes as each envelope moves past the roller 12.

The conveyor 16 delivers each envelope 1, onto a dead plate 20 which is at right angles to the conveyor 16. A feed roller 21 pushes the envelope 1 in a path perpendicular to its original on overlaping conveyor 11 which is moved by roller 22 to move the envelope along the plate 20 past the pair of each rollers 13. Upstanding rails are provided to prevent each envelope from moving off the plate 20. A hold down spring-pressed clamp 34 applies pressure to the conveyor 11 to hold the envelope down.

The rollers 13 are mounted on each side of the plate 20 at breaks 26 in the rails 23 so that the end edges of the envelope are exposed to the roller 13 and the rollers can apply chemicals thereto. The rollers 13 are also made of porous steel and receive their chemicals from a suitable reservoir (not shown).

After the envelopes have had their end edges coated with a chemical they are deposited by a take-off roller 35 and a ramp 24 container 25 for storage and subsequent use.

The chemicals applied by rollers 12 and 13 may be sodium propyl sulfate for the sensitizing chemical and 2½% tartaric acid for the developing chemical.

In addition to tartaric acid as the developing agent, oxalic acid, malonic and maleic acid will also work although tartaric acid appears to be the preferable form to use. The most common form of tartaric acid is d-tartaric acid which is a by-product of the wine industry and which can be purchased at relatively pure grade (Macalester-Bicknell TX15 Tartaric Acid, N.F., Crystals). If other acids are to be used, then the solution will be 10% for oxalic acid and 8% for malonic or maleic acid. All of these solutions are soluble in propanol or in water although propanol solution may work, it appears important that some water be available for the hydrolysis of sodium n-proply sulfate. The amount of water naturally absorbed in water may be sufficient but if it is not, some water may be added to the propanol solution.

If alkyl sodium sulfate is used, the lower molecular weight alkyl compounds, such as n-propyl and hexyl compounds are preferred over the higher weights. One example of a usable higher molecular weight compound is sodium lauryl sulfate which is a dodecyl compound available in the trade in "Steponal WA" and "Duponol WAQ" . The compound of choice is n-propyl sodium sulfate. It may be present to the extent of 10% in an isopropyl alcohol solution which may also comprise about 10% water.

It will thus be seen that an improved method and mechanism for automatically coating the three sides of an envelope expiditiously with mimimum handling and whereby the amount of chemicals applied are adequately controlled by the mechanism and method of the present invention.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

What is claimed is:

1. A mechanism for applying a chemical solution to envelope edges which comprises a first conveyor for moving an envelope in a first direction, said first conveyor being narrower than said envelope so that an edge of the envelope extends beyond an edge of the first conveyor, a first applicator roller located adjacent said first conveyor and spaced transversely therefrom so that the extending evelope edge contacts said first roller to have a chemical solution applied thereto as the envelope moves past the first roller, a second conveyor mounted at right angles to the first conveyor for moving the envelope in a second direction at a right angle to said first direction, the second conveyor being narrower than the envelope so that opposed edges of the envelope extend beyond opposed edges of the second conveyor, a pair of second applicator rollers located adjacent opposite edges of the second conveyor and spaced transversely therefrom so that said extending envelope edges contact said second rollers to have a chemical applied thereto as the envelope moves past the second rollers, the portions of said first and second rollers which contact said envelope edges being on the same plane as the said conveyors, means for transferring the envelope from said first conveyor to said second conveyor, said transfer means comprising a dead plate interposed between said first and second conveyor, said dead plate being at least as large as the envelope so that the envelope is unaffected by said first and second conveyors while on said dead plate, a transfer roller on said dead plate to move the envelope from said dead plate to said second conveyor, a spring-pressed hold-down shoe being provided over the first conveyor to keep said envelope on said conveyor, said shoe provided with a downwardly extending lip opposite the first roller to contact the envelope and to move the edge of the envelope beyond the conveyor into contact with the first roller, said dead plate extending beneath the second conveyor for at least the greater portion of its length, said transfer roller mounted below said dead plate and extending through an opening in the dead plate between the first and second conveyors to move the envelope into contact with said second conveyor, said second conveyor having a spring-pressed hold-down shoe mounted therewithin, guide rails being provided to guide the envelopes along said dead plate and interruptions in the guide rails to accommodate the applicator rollers, and the applicator rollers being at right angles to the conveyors and being made a porous steel, said dead plate being flat and uninterrupted throughout its area, except for the opening to accommodate said transfer roller.

* * * * *